US005970685A

United States Patent [19]

Huang

[11] Patent Number: 5,970,685

[45] Date of Patent: Oct. 26, 1999

[54] CUTTING MECHANISM FOR A THERMAL—SHRINKING FILM LABELING MACHINE

[76] Inventor: Fu-Chuan Huang, No. 111-11, Chung Chuang Tsun, Shui Shang Hsiang, Chia, Hsien, Taiwan

[21] Appl. No.: 08/918,105

[22] Filed: Aug. 27, 1997

[51] Int. Cl.[6] ..... B65B 41/00

[52] U.S. Cl. ..... 53/389.3; 83/597; 83/607; 83/663; 156/86

[58] Field of Search ..... 53/389.3; 83/54, 83/607, 597, 639.5, 946, 639.1, 663; 156/556, 86

[56] References Cited

U.S. PATENT DOCUMENTS

| | | | |
|---|---|---|---|
| 4,412,876 | 11/1983 | Lerner et al. | 156/86 |
| 4,806,187 | 2/1989 | Fujisawa | 156/86 |
| 5,367,858 | 11/1994 | Haasl | 53/389.3 |
| 5,385,073 | 1/1995 | Truemner et al. | 83/54 |
| 5,460,026 | 10/1995 | Schafer | 83/54 |
| 5,531,858 | 7/1996 | Hong | 83/54 |
| 5,655,427 | 8/1997 | Infanger | 83/663 |

*Primary Examiner*—Eugene L. Kim
*Attorney, Agent, or Firm*—Varndell & Varndell, PLLC

[57] ABSTRACT

A cutting mechanism installed in a thermal-shrinking film labeling machine around a cylindrical guide shaft and controlled to cut a tubular thermal-shrinking film being sleeved onto the cylindrical guide shaft, including an annular mounting plate fixedly mounted around the cylindrical guide shaft; a plurality of cutting tool assemblies respectively mounted on the annular mounting plate and equiangularly spaced around the guide shaft, each cutting tool assembly including a rotary tool holder alternatively turned back and forth about an axis within a set angle, a double-edge cutting blade fixedly fastened to the rotary tool holder and turned with it to move over an annular groove around the cylindrical guide shaft in cutting off cut the tubular thermal shrinking film; and driving means controlled to turn the rotary tool holder of each cutting tool assembly back and forth.

6 Claims, 8 Drawing Sheets

CUTTING MECHANISM FOR A THERMAL—SHRINKING FILM LABELING MACHINE

BACKGROUND OF THE INVENTION

The present invention relates to a cutting mechanism used in a thermal-shrinking film labeling machine and controlled to cut a thermal-shrinking film, and more particularly to such a cutting mechanism which uses compressed air (hydraulic oil) to turn a set of cutting tool assemblies back and forth in cutting a tubular thermal-shrinking film at a cylindrical shaft.

Various thermal-shrinking film labeling machines have been disclosed for use in fastening a printed thermal-shrinking film to commercial products. These thermal-shrinking film labeling machines commonly have a cutting mechanism controlled to cut off the thermal-shrinking film. FIG. 1 shows a cutting mechanism for a thermal-shrinking film labeling machine according to the prior art in which a wheel A2 is revolvably mounted around a shaft A1, and a tool holder A3 is revolvably supported on the wheel A2 to hold a cutting blade A4. When the wheel A2 is turned by a belt transmission mechanism (not shown), the tool holder A3 is simultaneously turned, causing the cutting blade A4 to cut a tubular thermal-shrinking film (not shown) at along an annular groove A5 of the cylindrical shaft A1. This structure of cutting mechanism has a complicated structure. Further, when the wheel A2 is turned through one run, the cutting blade A4 must be returned to their former positions for a next cutting operation. Therefore, this structure of cutting mechanism is not efficient in use. FIG. 2 shows another structure of cutting mechanism for a thermal-shrinking film labeling machine according to the prior art, in which a wheel B2 is revolvably mounted around a shaft B1, a cutting tool assembly B4 is pivoted to the wheel B2 to hold a cutting blade B7, a spring device B3 is coupled between the wheel B2 and the cutting tool assembly B4, a first push block B5 adapted to push the cutting tool assembly B4 into the cutting position, and a second push block B6 adapted to push the spring device B3 in returning the cutting tool assembly B4. This structure of cutting mechanism is still complicated and not efficient in use. FIG. 3 shows still another structure of cutting mechanism for a thermal-shrinking film labeling machine according to the prior art, in which a plurality of cutting tool assemblies C2 are arranged around a center shaft C1 to hold a respective cutting blade C3 and turned by a motor C5 through toothed belts C6;C7. When the cutting tool assemblies C2 are turned, the cutting blades C3 are moved over an annular groove C4 around the periphery of the center shaft C1 to cut a thermal-shrinking film. After each cutting operation, the cutting tool assemblies must be synchronously turned through 360° and then retained in position for a next cutting operation. Because the effective cutting angle of the cutting blade of each cutting tool assembly is within 180°, much time is wasted in returning the cutting tool assemblies after each cutting operation. FIG. 4 shows still another structure of cutting mechanism for a thermal-shrinking film labeling machine according to the prior art, in which four links D2 are pivotably arranged around a center shaft D1 to hold a respective cutting blade D3 at one end and a respective roller D5 at an opposite end, and a cam D4 is turned to move the rollers D5 of the links D2, causing the cutting blades D4 to be moved back and forth relative to the periphery of the center shaft D1 in cutting a tubular thermal-shrinking film. Further, each cutting blade D3 is mounted on a respective dovetail block that can be adjusted in a dovetail groove and then fixed at the desired locating to fit the diameter of the tubular thermal-shrinking film to be cut. This structure of cutting mechanism is still complicated. Furthermore, the applicable position adjusting range of the cutting blade D3 is limited. Therefore, this structure of cutting mechanism is not suitable for cutting tubular thermal-shrinking films having a great difference in diameter.

SUMMARY OF THE INVENTION

The present invention has been accomplished to provide a cutting mechanism for a thermal-shrinking film labeling machine which eliminates the aforesaid drawbacks. According to one aspect of the present invention, the cutting mechanism is installed in a thermal-shrinking film labeling machine around a cylindrical guide shaft and controlled to cut a tubular thermal-shrinking film being sleeved onto the cylindrical guide shaft, comprising an annular mounting plate fixedly mounted around the cylindrical guide shaft; a plurality of cutting tool assemblies respectively mounted on the annular mounting plate and equiangularly spaced around the guide shaft, each cutting tool assembly comprising a rotary tool holder alternatively turned back and forth about an axis within a set angle, a double-edge cutting blade fixedly fastened to the rotary tool holder and turned with it to move over an annular groove around the cylindrical guide shaft in cutting off cut the tubular thermal shrinking film; and driving means controlled to turn the rotary tool holder of each cutting tool assembly back and forth. According to another aspect of the present invention, the driving means can be a hydraulic oil source or compressed air source controlled to provide a hydraulic oil or a flow of compressed air through the rotary tool holders via a control valve and loop system forwardly and then backwardly, causing the rotary tool holders to be turned back and forth in cutting the tubular thermal-shrinking film efficiently.

DETAILED DESCRIPTION OF THE PREFERRED EMBODIMENT

Figure 1:
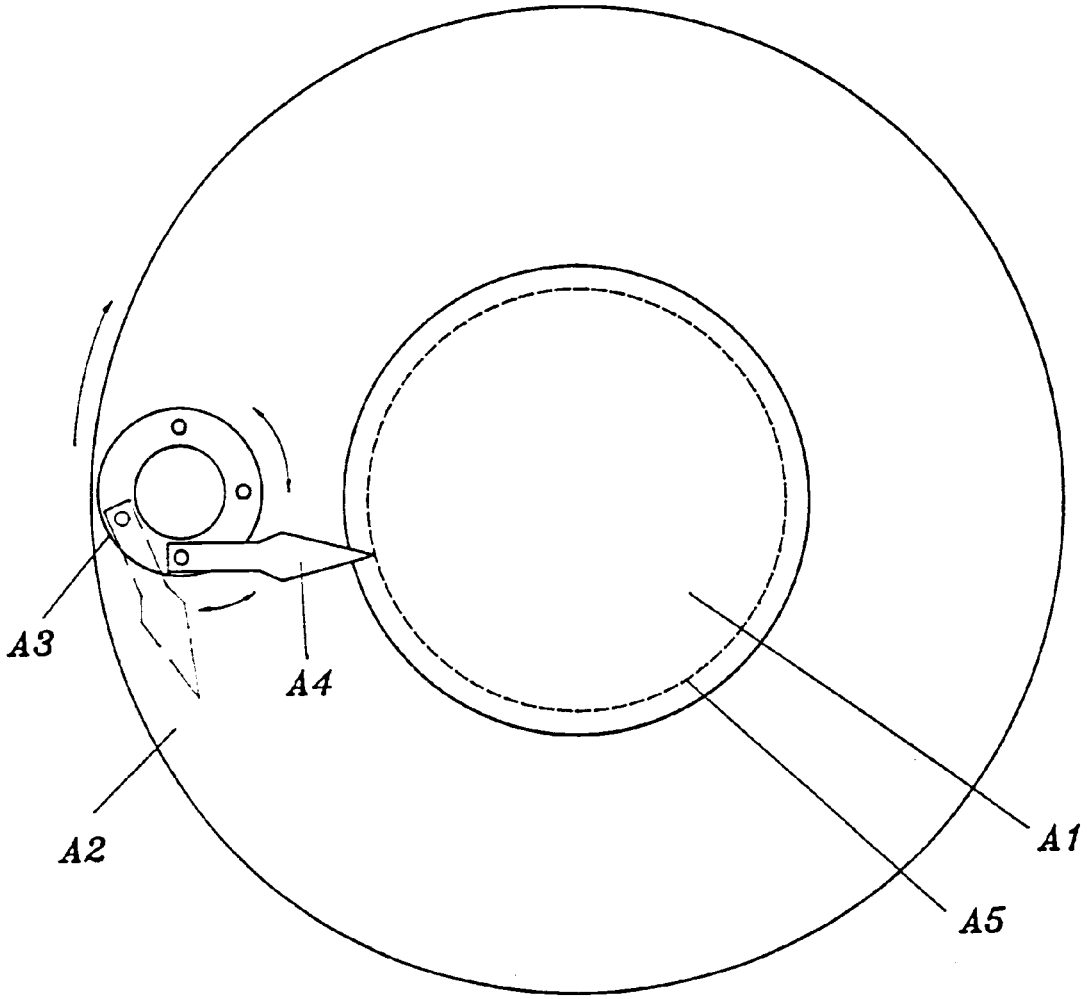
FIG. 1 PRIOR ART
FIG. 1 shows the arrangement of a cutting mechanism for a thermal-shrinking film labeling machine according to the prior art.
Figure 2:
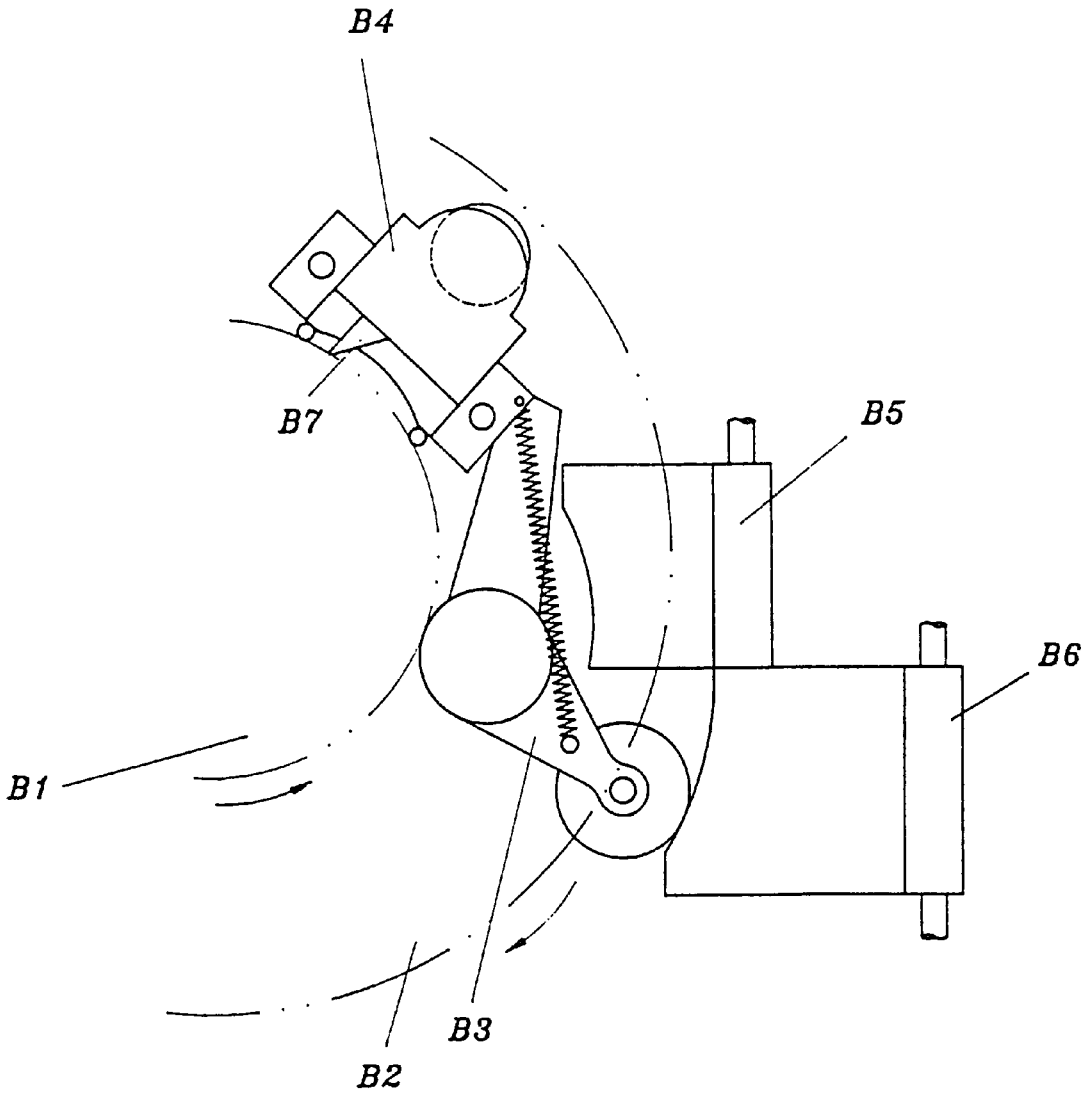
FIG.2 PRIOR ART
FIG. 2 shows the arrangement of another cutting mechanism for a thermal-shrinking film labeling machine according to the prior art.
Figure 3:
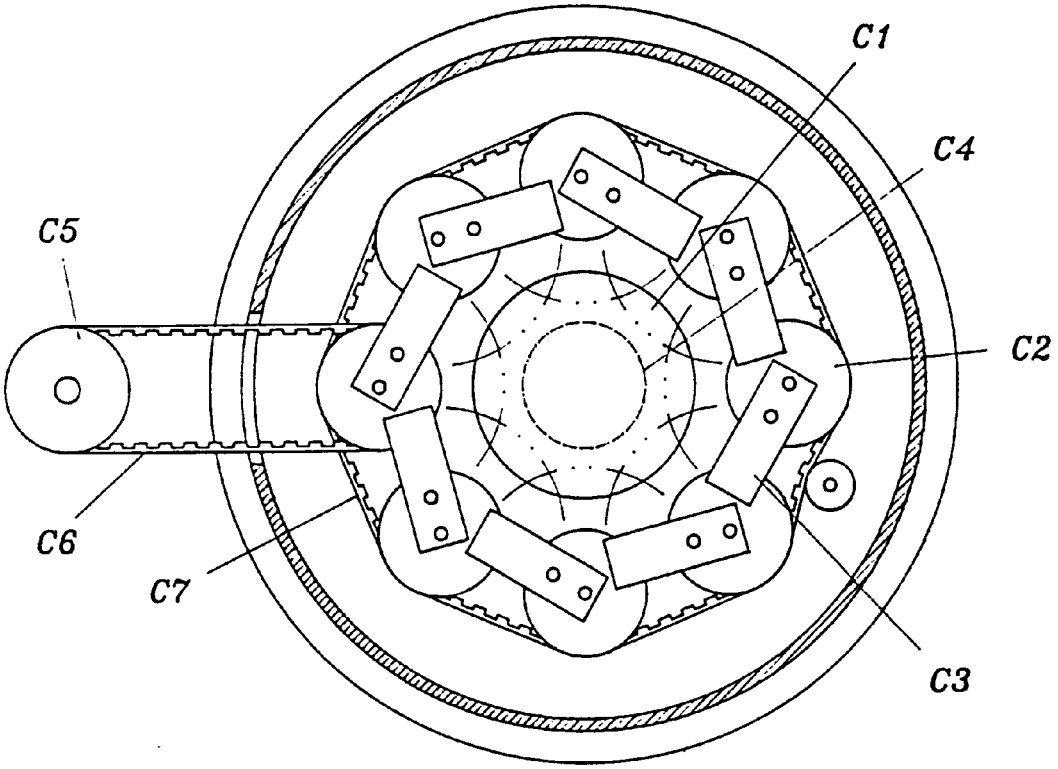
FIG.3 PRIOR ART
FIG. 3 shows the arrangement of still another cutting mechanism for a thermal-shrinking film labeling machine according to the prior art.
Figure 4:
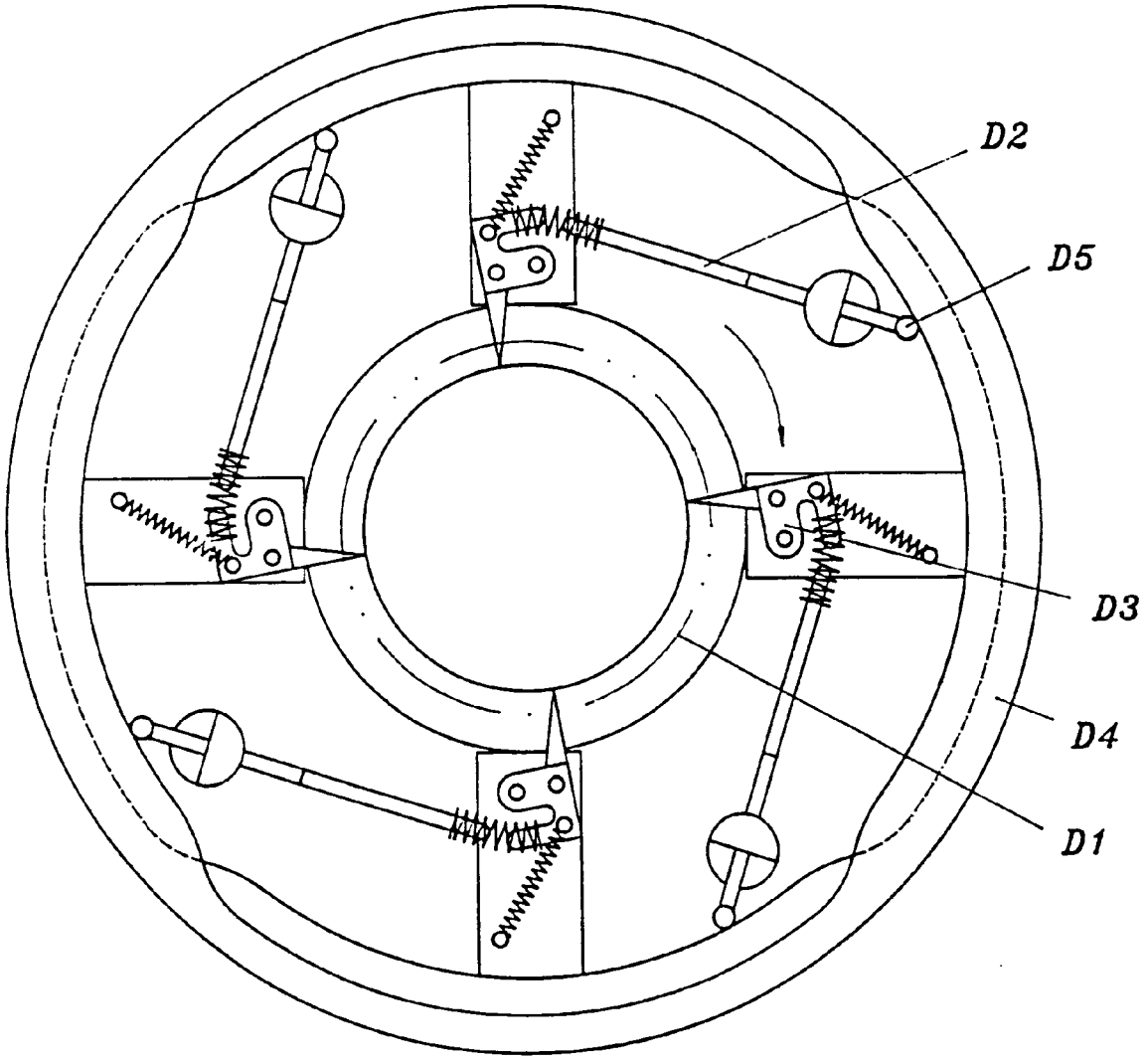
FIG.4 PRIOR ART
FIG. 4 shows the arrangement of still another cutting mechanism for a thermal-shrinking film labeling machine according to the prior art.
Figure 5:
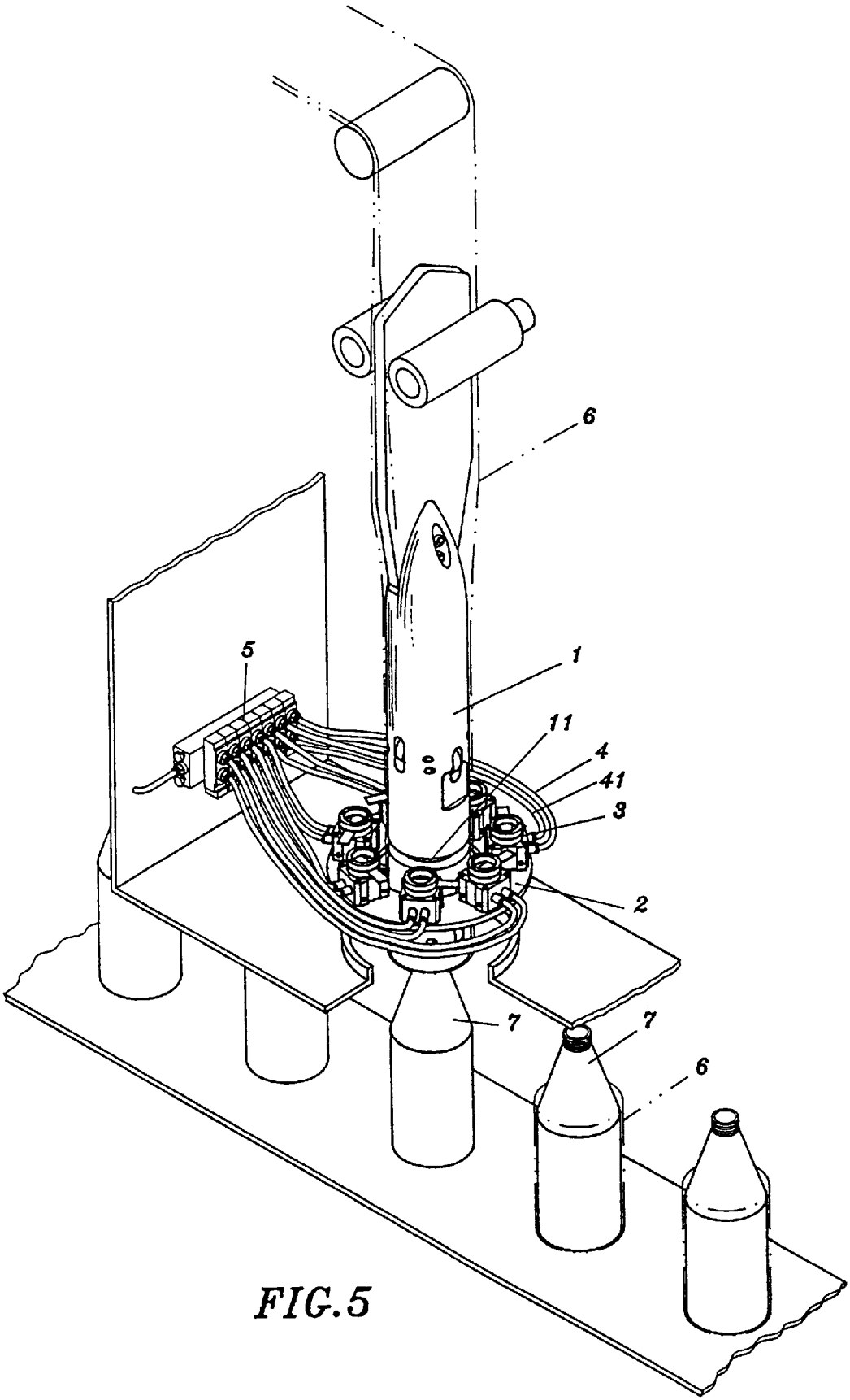
FIG. 5 is a perspective view of a part of a thermal-shrinking film labeling machine according to the present invention.
Figure 6:
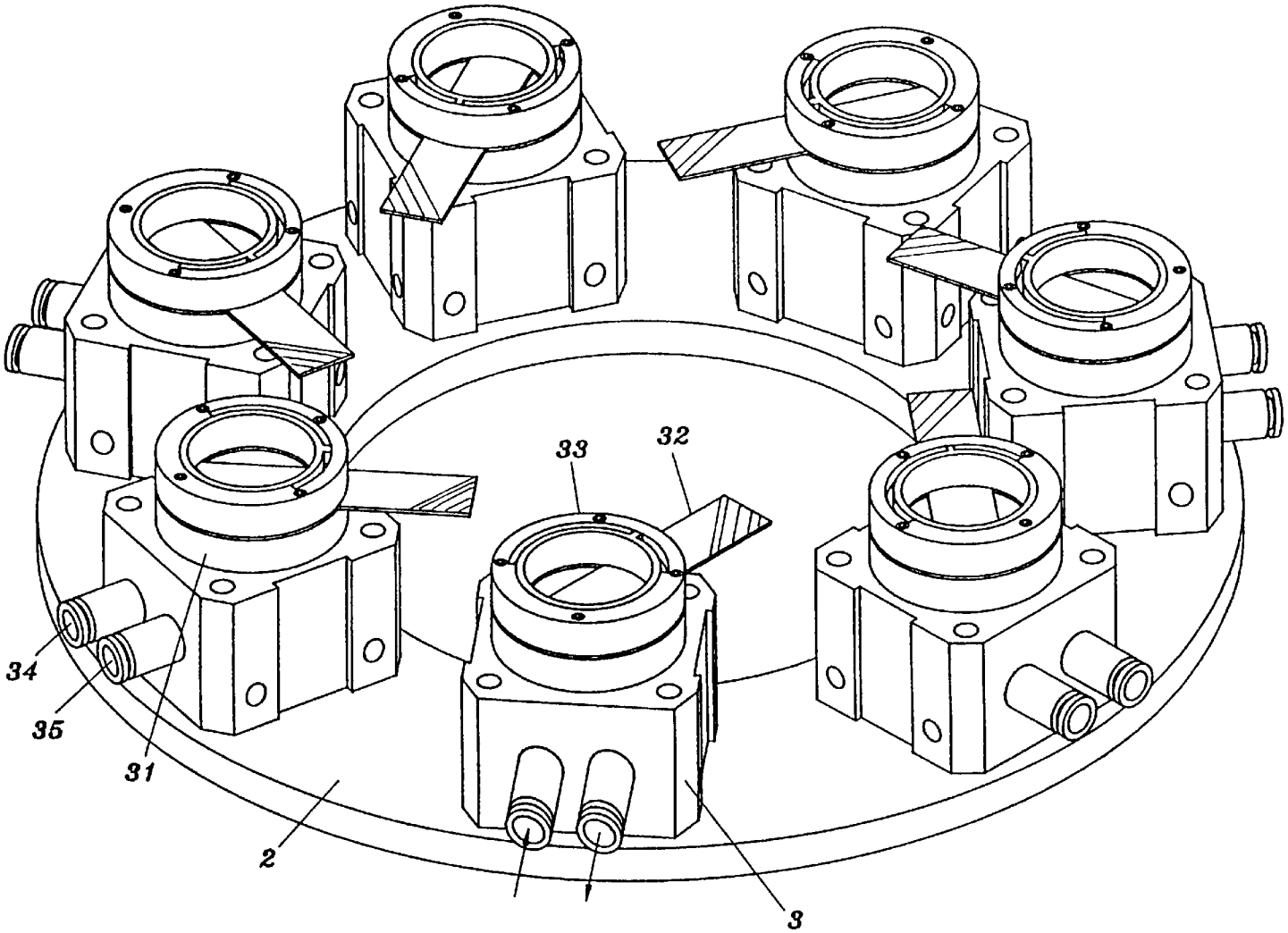
FIG. 6 is an enlarged view of the cutting mechanism of the thermal-shrinking film labeling machine shown in FIG. 5.

Referring to FIGS. 5 and 6, a cylindrical guide shaft 1 is disposed in a vertical position, having an annular groove 11 around its periphery. An annular mounting plate 2 is fixedly and horizontally mounted around the guide shaft 1 below the annular groove 11. A plurality of cutting tool assemblies 3 are fixedly mounted on the annular mounting plate 2 and equiangularly spaced around the guide shaft 1. Each cutting tool assembly 3 comprises a rotary tool holder 31, a double-edge cutting blade 32 fixedly fastened to the rotary tool holder 31, a cover 33 covered on the rotary tool holder 31 to fix the double-edge cutting blade 32 in place, a first pressure input/output connector 34, and a second pressure input/output connector 35. Further, a pressure control valve 5 is disposed outside the annular mounting plate 2, having an input end connected to a pressure source (not shown) and a plurality of output ends respectively connected to the first pressure input/output connectors 34 and second pressure input/output connectors 35 of the cutting tool assemblies 3 by respective first guide tubes 4 and second guide tubes 41.

Figure 7:
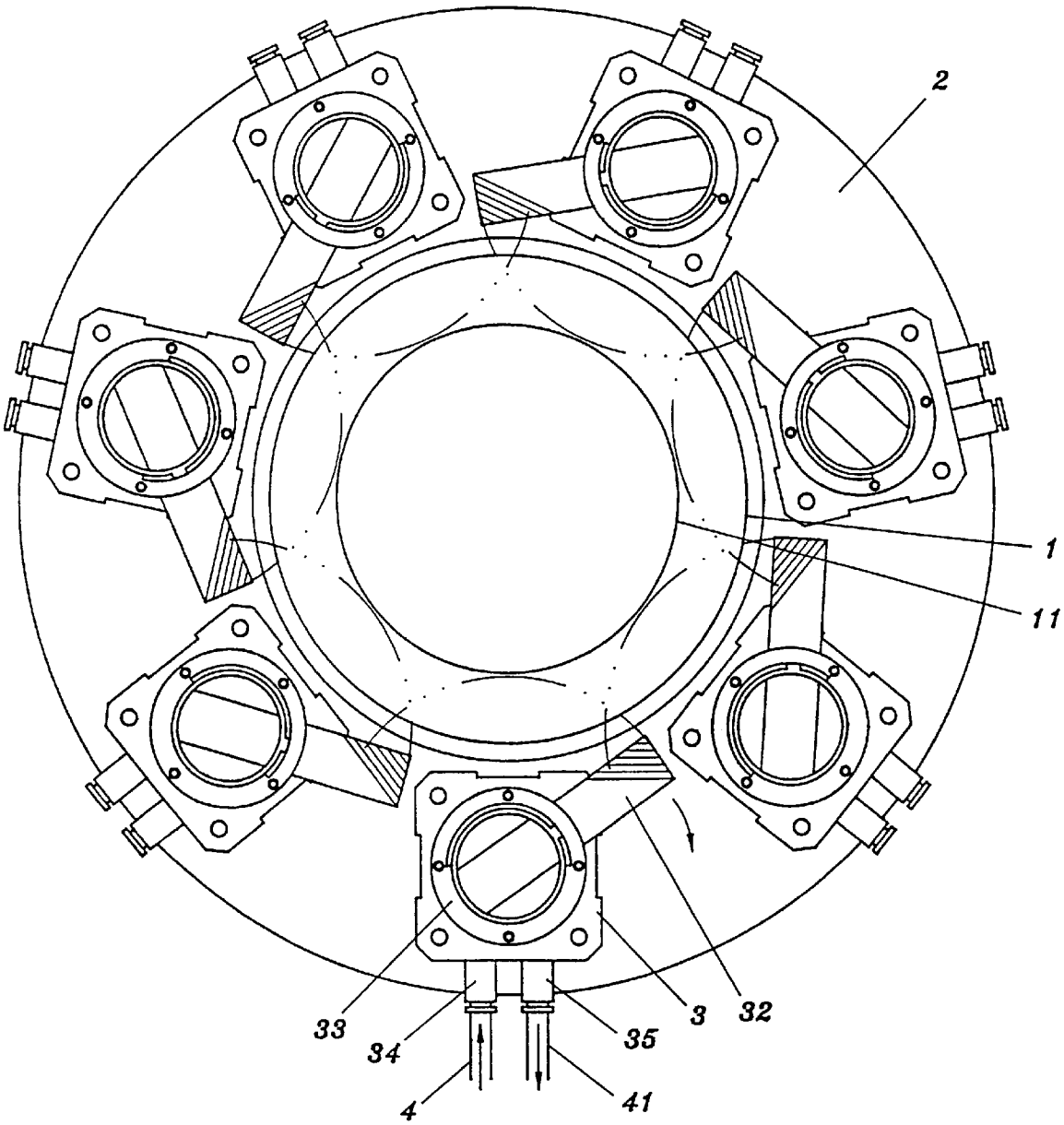
FIG. 7 is a top view of the present invention, showing a first cutting stroke of the cutting mechanism.
Figure 8:
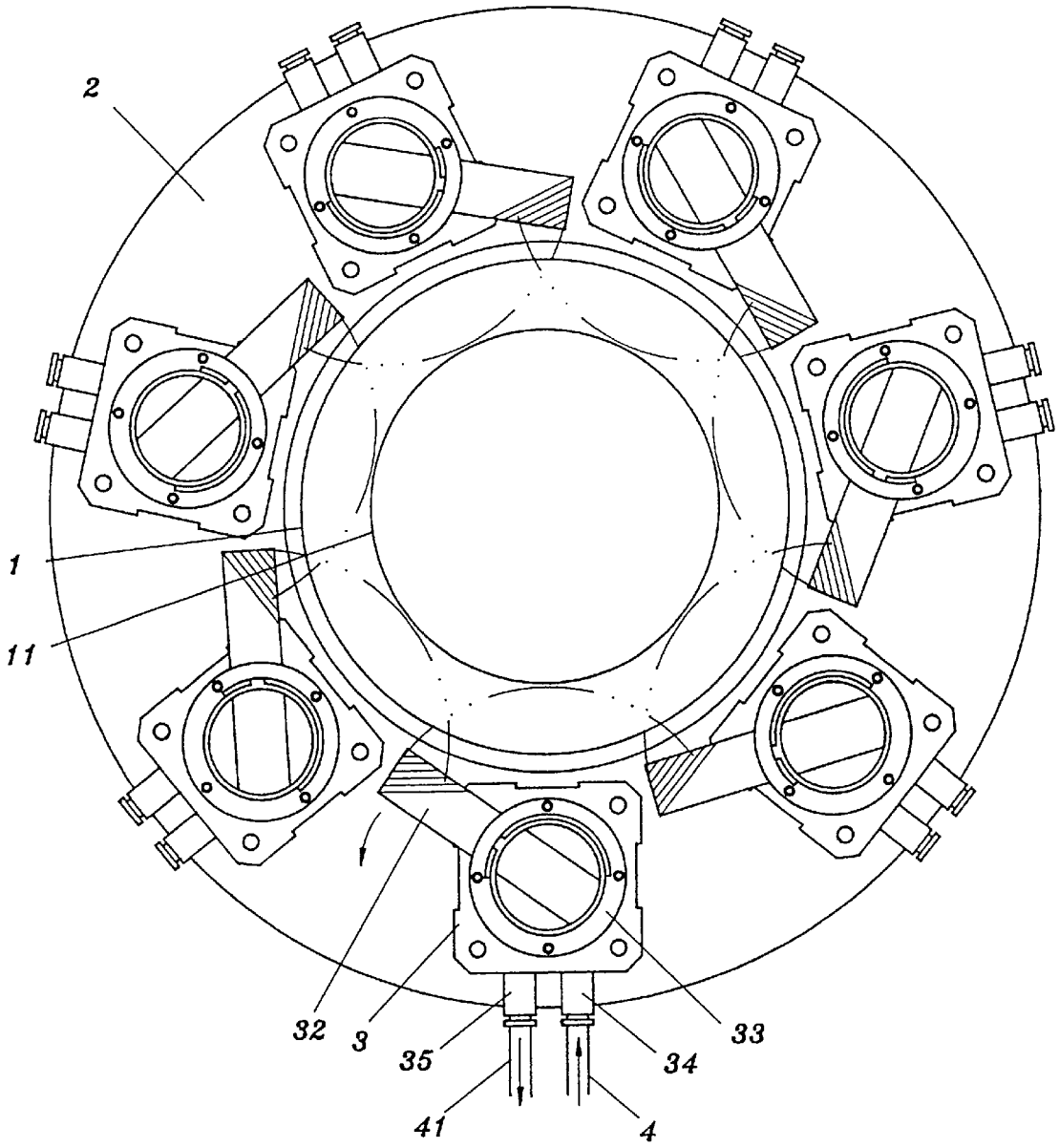
FIG. 8 is another top view of the present invention, showing a second cutting stroke of the cutting mechanism.

Referring to FIGS. 7 and 8 and FIG. 5 again, when a tubular thermal shrinking film 6 is delivered by rollers and sleeved onto the guide shaft 1, the pressure control valve 5 is controlled to provide a flow of compressed air (or hydraulic oil) through the first guide tubes 4 to the first pressure input/output connectors 34 of the cutting tool assemblies 3, causing the rotary tool holder 31 of each cutting tool assembly 3 to be turned horizontally in one direction (see FIG. 7) When the rotary tool holder 31 of each cutting tool assembly 3 is turned in one direction, the double-edge cutting blades 32 of the cutting tool assemblies 3 are moved over the tubular thermal shrinking film 6 against the annular groove 11 of the guide shaft 1, and therefore the tubular thermal shrinking film 6 is cut off (see FIG. 7), permitting the cut piece of tubular thermal shrinking film 6 to fall to one commercial product 6 to be packed (see FIG. 5). After cutting, the pressure control valve 5 is controlled to let compressed air (or hydraulic oil) pass through the second guide tubes 41 to the second pressure input/output connectors 34 of the cutting tool assemblies 3, causing the rotary tool holder 31 of each cutting tool assembly 3 to be turned horizontally in the reversed direction (see FIG. 8). When the rotary tool holder 31 of each cutting tool assembly 3 is turned in the reversed direction, the double-edge cutting blades 32 of the cutting tool assemblies 3 are moved over the tubular thermal shrinking film 6 against the annular groove 11 of the guide shaft 1, and therefore the tubular thermal shrinking film 6 is cut again (see FIG. 8), permitting the cut piece of tubular thermal shrinking film 6 to fall to a next commercial product 7 to be packed. Further, the rotary tool holders 31 of each two adjacent cutting tool assemblies 3 are turned in reversed directions when the cutting mechanism is operated, therefore the respective double-edge cutting blades 32 can be acted against each other to fully cut off the tubular thermal shrinking film 6.

Referring to FIGS. 5, 7 and 8 again, the first guide tubes 4, the first pressure input/output connectors 34, the second pressure input/output connectors 35, the second guide tubes 41 and the pressure control valve 5 form a loop. When compressed air (or hydraulic oil is forced from the pressure control valve 6 through the first guide tubes 4 into the first pressure input/output connectors 34 to turn the respective rotary tool holders 31 in one direction, it flows out of the cutting tool assemblies 3 through the second pressure input/output connectors 35 and returns to the pressure control valve 5 via the second guide tubes 41. On the contrary, when compressed air (or hydraulic oil is forced from the pressure control valve 5 through the second guide tubes 41 into the second pressure input/output connectors 35 to turn the respective rotary tool holders 31 in the reversed direction, it flows out of the cutting tool assemblies through the first pressure input/output connectors 34 and returns to the pressure control valve 5 via the first guide tubes 4. Further, the horizontal turning angle of the rotary tool holders 31 of the cutting tool assemblies 3 can be adjusted within 180° to fit different sizes of tubular thermal shrinking film.

While only one embodiment of the present invention has been shown and described, it will be understood that various modifications and changes could be made there unto without departing from the spirit and scope of the invention disclosed. For example, electronic type reciprocating control circuit means may be used to turn the rotary tool holders back and forth within the desired angle.

I claim:

1. A cutting mechanism installed in a thermal-shrinking film labeling machine around a cylindrical guide shaft and controlled to cut a tubular thermal-shrinking film being sleeved onto said cylindrical guide shaft, comprising:

an annular mounting plate fixedly mounted around said cylindrical guide shaft below an annular groove extending around said cylindrical guide shaft;

a plurality of cutting tool assemblies respectively mounted on said annular mounting plate and equiangularly spaced around said guide shaft, each of said cutting tool assemblies comprising a rotary tool holder alternatively turned back and forth about an axis within a set angle, a double-edge cutting blade fixedly fastened to and turned by said rotary tool holder to move over said annular groove of said cylindrical guide shaft for cutting said tubular thermal shrinking film; and driving means controlled to turn the rotary tool holder of each of said cutting tool assemblies back and forth.

2. The cutting mechanism of claim 1, wherein the rotary tool holder of each of said cutting tool assemblies is set to turn within 180°.

3. The cutting mechanism of claim 1, wherein the rotary tool holders of each two adjacent cutting tool assemblies are synchronously turned in reversed directions so that the double-edge cutting blades of each two adjacent cutting tool assemblies can act against each other.

4. The cutting mechanism of claim 1, wherein said driving means is an electronic type reciprocating control circuit device controlled to turn the rotary tool holder of each cutting tool assembly back and forth.

5. The cutting mechanism of claim 1, wherein said driving means comprises a hydraulic oil source, a hydraulic oil control valve controlled to deliver a hydraulic oil from said hydraulic oil source to said tool holder assemblies, a plurality of first pressure input/output connectors respectively mounted on said cutting tool assemblies for guiding in the hydraulic oil to turn the respective rotary tool holders in one direction, a plurality of second pressure input/output connectors respectively mounted on said cutting tool assemblies and disposed in communication with said first pressure input/output connectors for guiding in the hydraulic oil to turn the respective rotary tool holder in the reversed direction, and a plurality of hydraulic oil guide tubes respectively connected between said hydraulic oil control valve and the first pressure input/output connectors and second pressure input/output connectors of the rotary tool holders of said cutting tool assemblies.

6. The cutting mechanism of claim 1, wherein said driving means comprises a compressed air source, a compressed air control valve controlled to deliver a compressed flow of air from said hydraulic oil source to said tool holder assemblies, a plurality of first pressure input/output connectors respectively mounted on said cutting tool assemblies for guiding in the compressed flow of air to turn the respective rotary tool holders in one direction, a plurality of second pressure input/output connectors respectively mounted on said cutting tool assemblies and disposed in communication with said first pressure input/output connectors for guiding in the compressed flow of air to turn the respective rotary tool holder in the reversed direction, and a plurality of air guide tubes respectively connected between said compressed air control valve and the first pressure input/output connectors and second pressure input/output connectors of the rotary tool holders of said cutting tool assemblies.

* * * * *